US006971218B1

(12) United States Patent
Huckaba et al.

(10) Patent No.: US 6,971,218 B1
(45) Date of Patent: Dec. 6, 2005

(54) METHOD AND APPARATUS FOR BANDING A WRAPPED BUNDLE OF ARTICLES

(76) Inventors: Clayton Huckaba, 6820 E. 1400th Rd., Martinsville, IL (US) 62442; Bruce Gross, 511 Horseshoe La., Casey, IL (US) 62420

( * ) Notice: Subject to any disclaimer, the term of this patent is extended or adjusted under 35 U.S.C. 154(b) by 0 days.

(21) Appl. No.: 10/857,487

(22) Filed: Jun. 1, 2004

(51) Int. Cl.[7] ..... B65B 13/02

(52) U.S. Cl. ..... 53/399; 53/419; 53/583; 53/139.1; 53/586

(58) Field of Search ..... 53/399, 419, 139.1, 53/583, 586; 156/483

(56) References Cited

U.S. PATENT DOCUMENTS 2,873,564 A * 2/1959 Bogeskov ..... 53/399
3,535,189 A * 10/1970 Hall et al. ..... 53/586
3,729,896 A * 5/1973 Lehmann ..... 53/583
3,783,585 A * 1/1974 Hoyland ..... 53/583
3,886,026 A * 5/1975 Kienel ..... 53/586
3,922,834 A * 12/1975 Clayton ..... 53/139.1
4,466,227 A * 8/1984 Hanscom ..... 53/586
4,627,218 A * 12/1986 Akerstrom et al. ..... 53/135.3
5,295,345 A * 3/1994 Ter Haar ..... 53/583
5,410,861 A * 5/1995 Medlock ..... 53/586
5,600,934 A * 2/1997 van Rosendal et al. .... 53/139.1
6,023,913 A * 2/2000 Gray et al. ..... 53/399
6,202,387 B1 * 3/2001 Brown et al. ..... 53/419
6,615,566 B2 * 9/2003 Heisey ..... 53/466
6,826,891 B2 * 12/2004 Sauer ..... 53/399

* cited by examiner

*Primary Examiner*—John Sipos
(74) *Attorney, Agent, or Firm*—Kenneth E. Darnell

(57) ABSTRACT

Apparatus for banding a bundle of articles covered by a wrapping, such as tableware wrapped by a napkin, a manually wrapped bundle having at least one of said articles covered by said wrapping and being fed by a user of the apparatus into contact with a pre-cut elongated band having a cohesive material coated on at least certain surfaces of the band. The apparatus cuts the band to a desired length and positions the pre-cut band in surmounting relation to a pair of counter-rotating rollers, the rollers biasing the band about the bundle as the bundle passes between the rollers. On passage of the bundle between the rollers, cohesive material-coated ends of the band are brought together to adhere said ends together and to tightly band the wrapped articles together in essentially a single operational step.

18 Claims, 8 Drawing Sheets

Fig. 6D
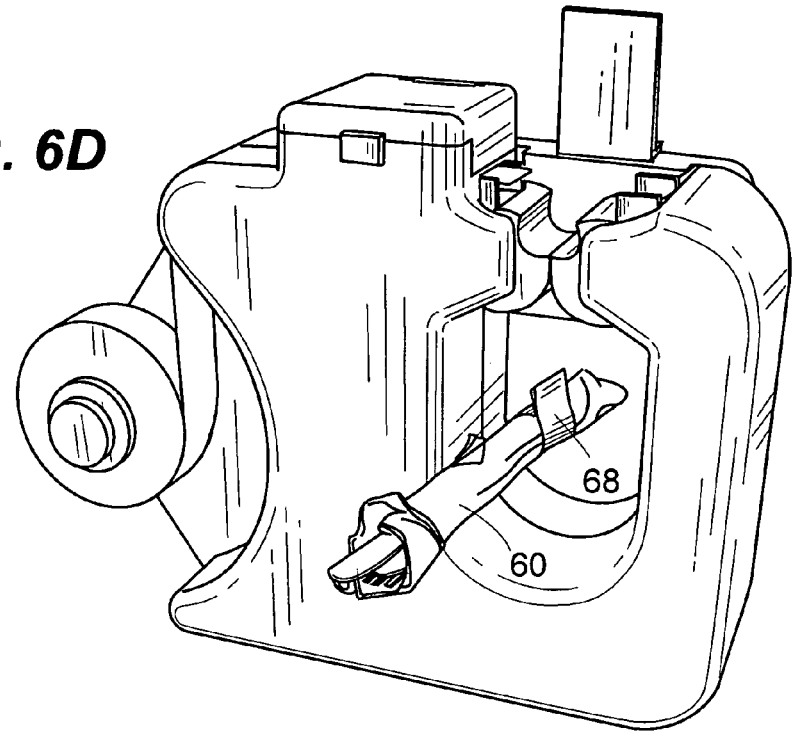
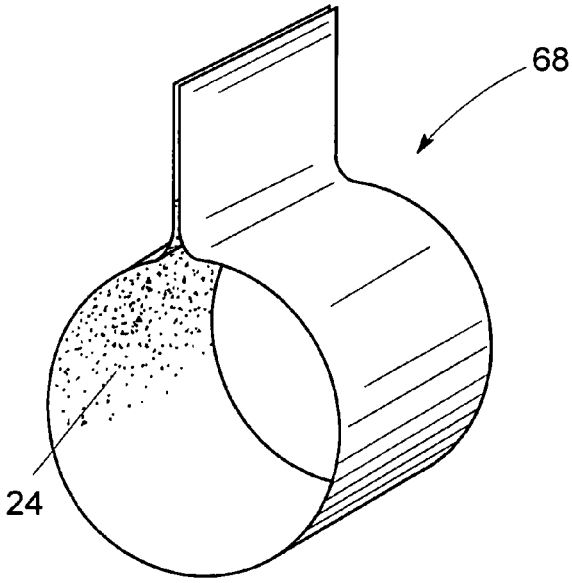
Fig. 6E
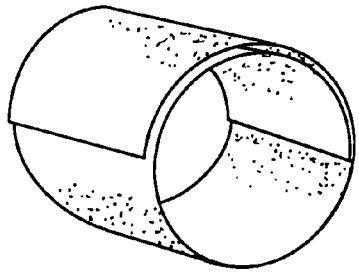
Fig. 6F
PRIOR ART

METHOD AND APPARATUS FOR BANDING A WRAPPED BUNDLE OF ARTICLES

BACKGROUND OF THE INVENTION

1. Field of the Invention

The invention relates generally to banding of discrete articles into a bundle whereby the articles are held together as a unit, the invention particularly relating to the assembly of a band having adhesive disposed thereon about tableware previously wrapped manually into a bundle covered by a napkin or the like.

2. Description of the Prior Art

Articles such as tableware are commonly assembled together and covered by a wrapping such as a napkin, linen, etc., for use at food service locations. Articles so wrapped into covered bundles are often banded by the placement of a band about the wrapped bundle, the band being tightly applied so as to maintain the articles within the wrapped bundle. Manual application of bands to wrapped bundles comprised of tableware of the like and a covering napkin formed of paper, linen or the like, is time consuming and subject to a certain degree to the skill of a person charged with wrapping and banding the articles of tableware or the like. Workers who are typically charged with the banding of wrapped bundles of tableware and the like often have a number of duties which must be discharged in food service situations and therefore have only a limited amount of time which can be devoted to wrapping of tableware within napkins followed by banding of wrapped bundles so formed. The art thus finds a need for a more rapid ability to band wrapped bundles formed of articles such as tableware and covered by a napkin or the like, it being desirable in the art to automate the banding of manually wrapped bundles in order to save time and to improve the uniformity and quality of the wrapped and banded bundles. Bands, such as are commonly formed of paper, are known in the art as being useful for holding napkin-wrapped silverware or the like together. As one example, Dunbar et al, in U.S. Pat. No. 5,469,688, discloses the folding of a napkin over silverware to form a napkin-wrapped bundle of silverware, a gummed band taken from a roll of such bands being wrapped about the napkin/silverware bundle in order to hold the napkin and the silverware together for subsequent use. In U.S. Pat. No. 6,202,387, Brown et al band a wrapped napkin/silverware bundle together. Banding apparatus is also disclosed by Gray et al, in U.S. Pat. No. 6,023,913, and by Medlock, in U.S. Pat. No. 5,410,861. Terragnoli, in U.S. Pat. No. 4,852,329, discloses a band having adhesive formed on portions of one surface thereof, said adhesive portions being spaced from each other and being brought into contact on assembly of the band to articles which are to be held together through the agency of the band. The apparatus disclosed in the United States patents mentioned above do not satisfy the long-felt need in the art for a simple, reliable and inexpensive device easily operable by relatively untrained personnel for applying banding to a wrapped bundle, such as tableware wrapped within a napkin or the like. The apparatus of the prior art is expensive, complex and not practically usable within a typical food service environment, such as a restaurant or the like, and therefore fails to meet particular needs of at least a certain category of users. Accordingly, the invention provides solution to this long-felt need by providing a compact, relatively inexpensive and easily operated apparatus capable of banding wrapped bundles of articles such as tableware wrapped within napkins, the resulting banded bundles being particularly useful in food service situations such as in restaurants.

SUMMARY OF THE INVENTION

The invention provides method and apparatus for applying a band to a wrapped bundle formed of at least one article such as an article of tableware and which is wrapped in a sheet of material such as paper, linen or the like, for example, a napkin, the bundle being intended to be held securely together by the band. According to a preferred embodiment of the invention, an apparatus is provided having a continuous roll of banding material mounted thereto on a roll from which a predetermined length of the banding material is fed to a cutting blade to sever said banding material to said predetermined length. The length of banding material is fed prior to cutting to a location of the apparatus surmounting a pair of counter-rotating rollers, the rollers being mounted in abutting relation tangentially with rotary axes being parallel. Each of the rollers has at least one arcuate notch formed therein, each said notch being arranged to align with an opposing notch from the adjacent roller so that the wrapped bundle can be fed manually into that space defined by an opposed pair of notches of the pair of rollers. Feeding of the wrapped bundle in contact with the predetermined length of banding material, said length of banding material being intended to form the band which holds the wrapped bundle securely together, and thus into the space defined by the opposed pair of notches, causes the rollers to rotate a predetermined rotational distance to apply the band about the wrapped bundle and to then bias ends of the band together. While those surfaces of the banding material contacted by the wrapped bundle may not be covered with a cohesive or adhesive material, a preferred embodiment of the invention contemplates coating of full surfaces of the banding material with a cohesive material which bonds strongly to surfaces also covered by the same cohesive material. Accordingly, biasing of the ends of the band together causes said ends to adhere strongly to each other so that the band is tightly held about the wrapped bundle. As the band is being applied to the wrapped bundle, a second length of the banding material, that is, a second band, is pulled from the roll of banding material and cut to the predetermined length as said material is advanced to a position surmounting the counter-rotating rollers. The rollers then return to their initial position after the banding operation is completed. The second band is thereby positioned for application to another wrapped bundle on manual feeding of said wrapped bundle in a manner essentially identical to that described above so that the second band is applied to the second wrapped bundle. Rotation of the rollers causes a spacing to occur between the rollers when the pair of notches are displaced relative to each other a sufficient distance, the wrapped bundle having the band applied thereto thus having an opening located between said rollers through which the bundle can freely pass.

In the preferred embodiment of the invention, the axes of the counter-rotating rollers lie in a horizontal plane, a first one of the rollers rotating in a clockwise direction with the other roller rotating in a counter-clockwise direction. The circumferential surface of each of the rollers essentially moves downwardly such that the wrapped bundle is manually fed in a downward direction to contact the band, that is, the predetermined length of the banding material, which is disposed in surmounting relation to the rollers. Disposition of the axes of the rollers in a horizontal plane is preferred due to the desirability for maintaining the length of banding material in place over the rollers without a need to hold the banding material, only gravity being necessary to maintain the length of banding material at the appropriate location. The predetermined length of banding material is centered above the juncture between the rollers so that the ends of the length of banding material mate on operation of the apparatus.

The cohesive material preferably applied over full surfaces of one side of the banding material is preferably a low-tack material, it being understood for the purposes of this disclosure that the cohesive material can take the form of any suitable adhesive material capable of bonding to itself. A cohesive material is preferred, however, since a true cohesive material will essentially only bond to itself. Since some of the cohesive material coated onto surfaces of one side of the banding material will contact the wrapped bundle, it is desirable that the cohesive material not adhere to the wrapped bundle especially in applications of the invention wherein a wrapper enclosing items such as tableware takes the form of a napkin or the like. For purposes of this disclosure, the term "cohesive material" is taken to include any suitable cohesive or adhesive material. The coated surfaces of the banding material are disposed on that side of the banding material opposite the location of the counter-rotating rollers. The configuration of the counter-rotating rollers causes end portions of the pre-cut lengths of banding material to be mated together. Since the cohesive material employed has little or no tack to surfaces not coated with the same cohesive material, little or not cohesive material remains on any portion of the wrapped bundle that might contact the cohesive material once the band is removed at a later time. As noted, a wrapped bundle according to a preferred practice of the invention takes the form of eating utensils wrapped in a napkin or the like which will be used by a user of the utensils, it being desirable that extraneous material not adhere to the napkin.

Accordingly, it is an object of the invention to provide method and apparatus for applying a banding material to an article and particularly to a wrapped bundle formed of at least one article of tableware having a napkin or the like wrapped thereover.

It is another object of the invention to provide an inexpensive and volumetrically compact apparatus capable of automatic feeding of predetermined lengths of banding material from a roll of banding material to a location surmounting biasing surfaces capable of applying the banding material to an article such as a bundle of tableware utensils wrapped in a napkin or the like.

It is a further object of the invention to provide apparatus capable of applying bands having cohesive material disposed on one surface thereof to an article such as a wrapped bundle formed of at least one tableware utensil and a sheet such as a napkin, the apparatus applying in essentially a single operational step one of said bands to said wrapped bundle to securely hold said wrapped bundle together.

Further objects and advantages of the invention will become more readily apparent in light of the following detailed description of the preferred embodiments.

BRIEF DESCRIPTION OF THE DRAWINGS

FIG. 6D is a perspective view of the wrapped bundle with the strip of banding material cinched about the wrapped bundle as occurs on further rotation of the rollers and completion of the banding operation;

FIG. 6E is a perspective view of a cinched strip of banding material absent the wrapped bundle; and, FIG. 6F is a perspective view of a prior art band typically used in a banding a wrapped bundle.

DESCRIPTION OF THE PREFERRED EMBODIMENTS

Figure 1:
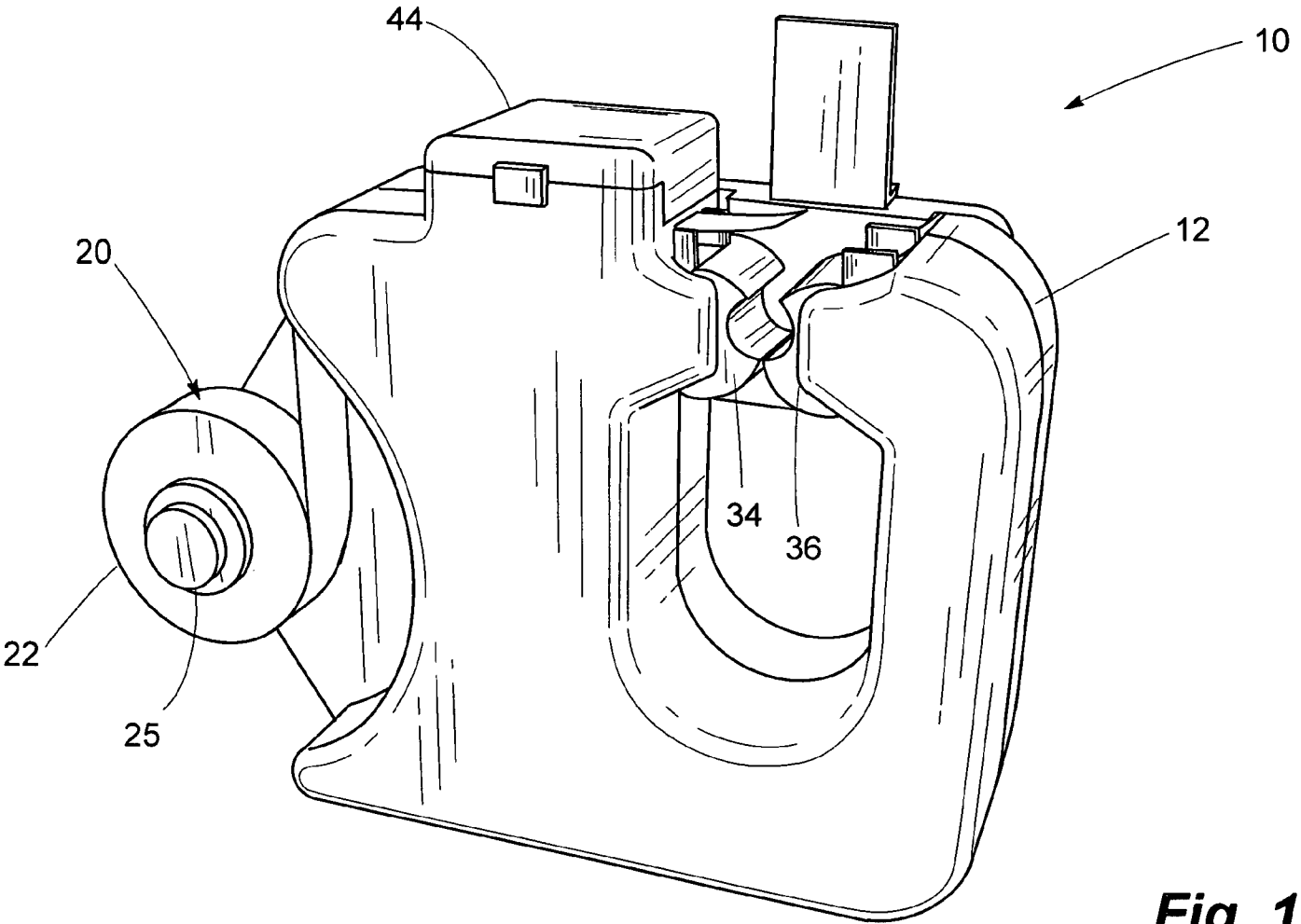
FIG. 1 is a perspective view taken from above and to one side of a banding apparatus configured to the invention.
Figure 2:
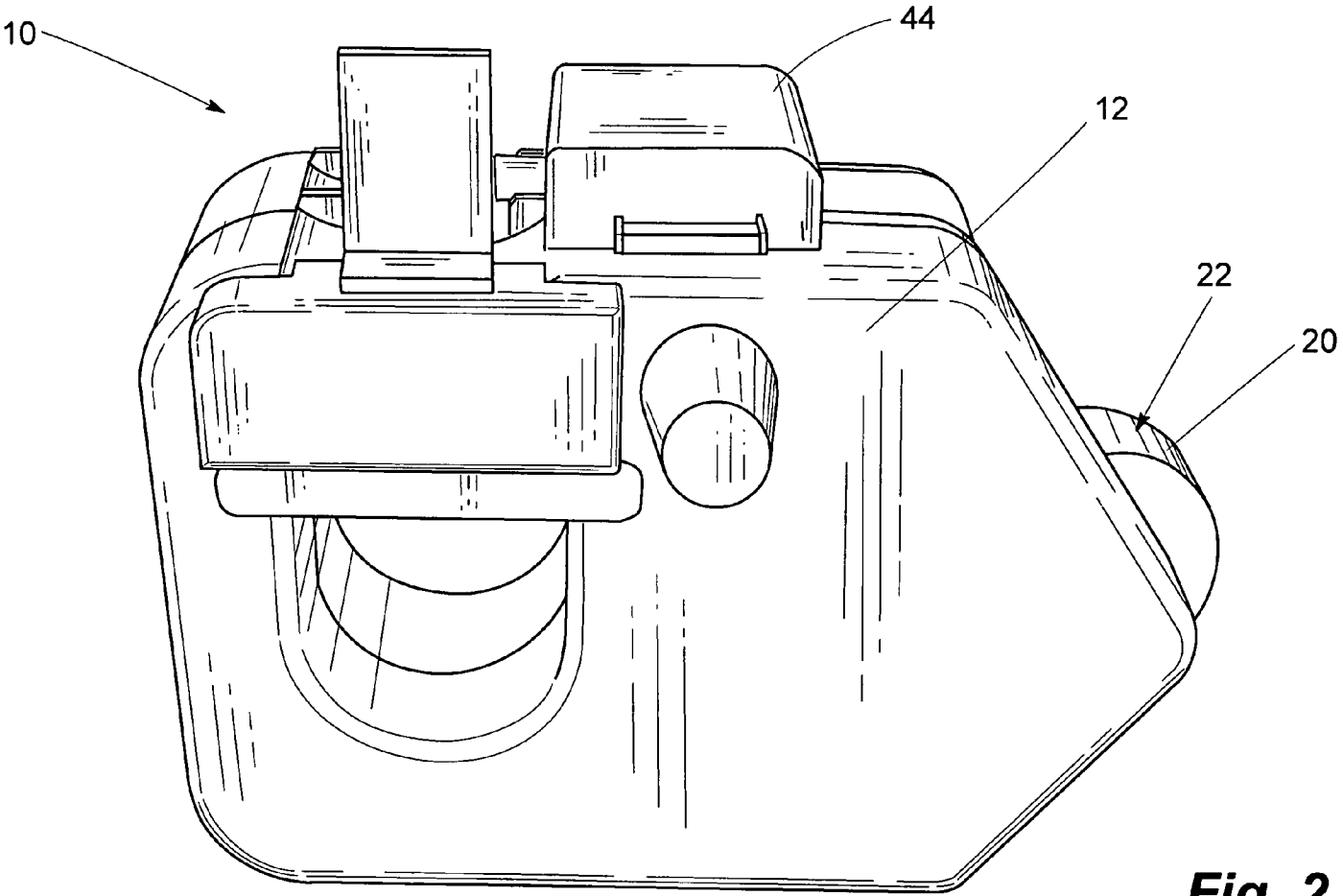
FIG. 2 is a perspective view taken from above and to an opposite side relative to the view of FIG. 1.
Figure 3:
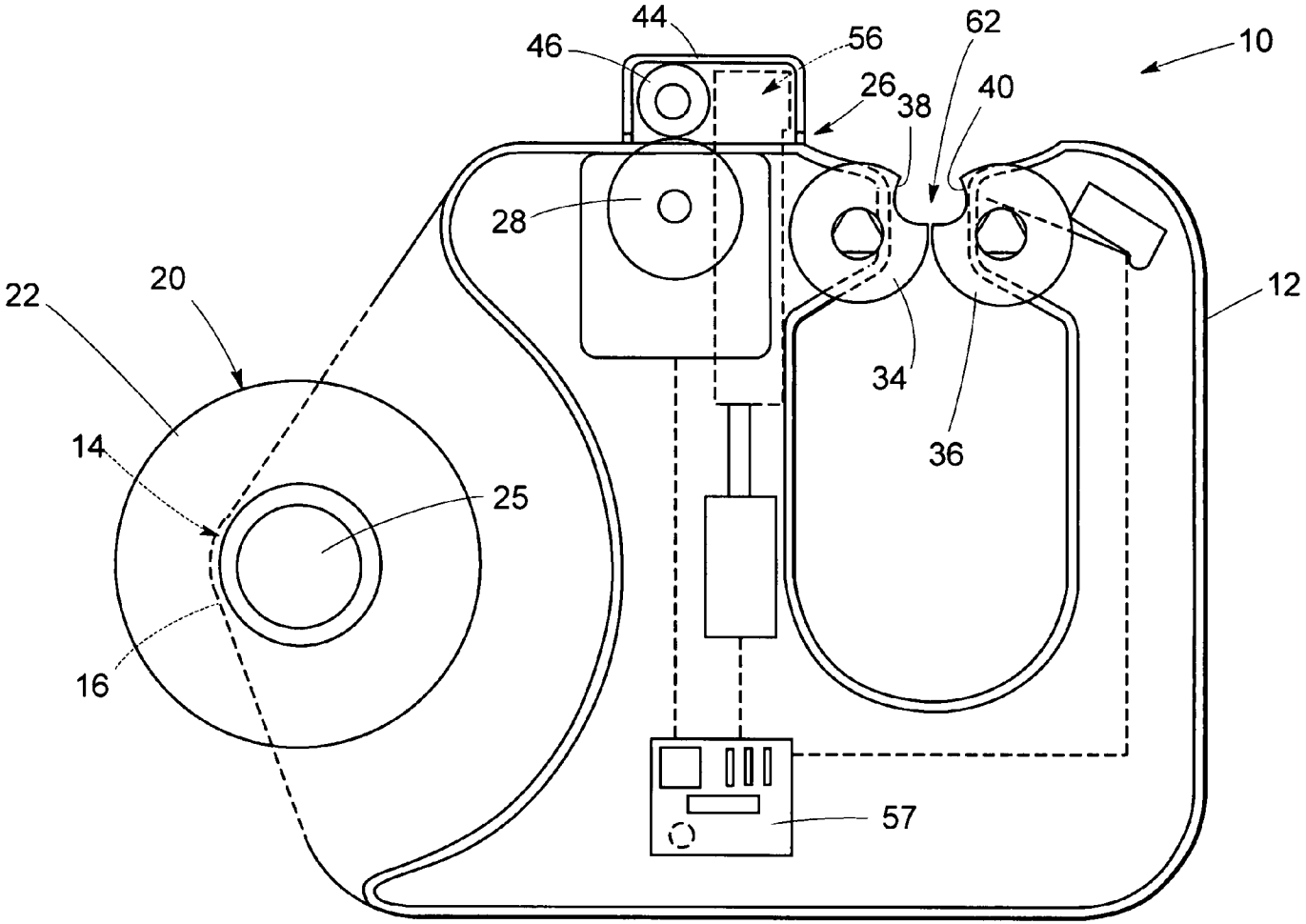
FIG. 3 is a block diagram illustrating the electromechanical components of the apparatus.
Figure 4:
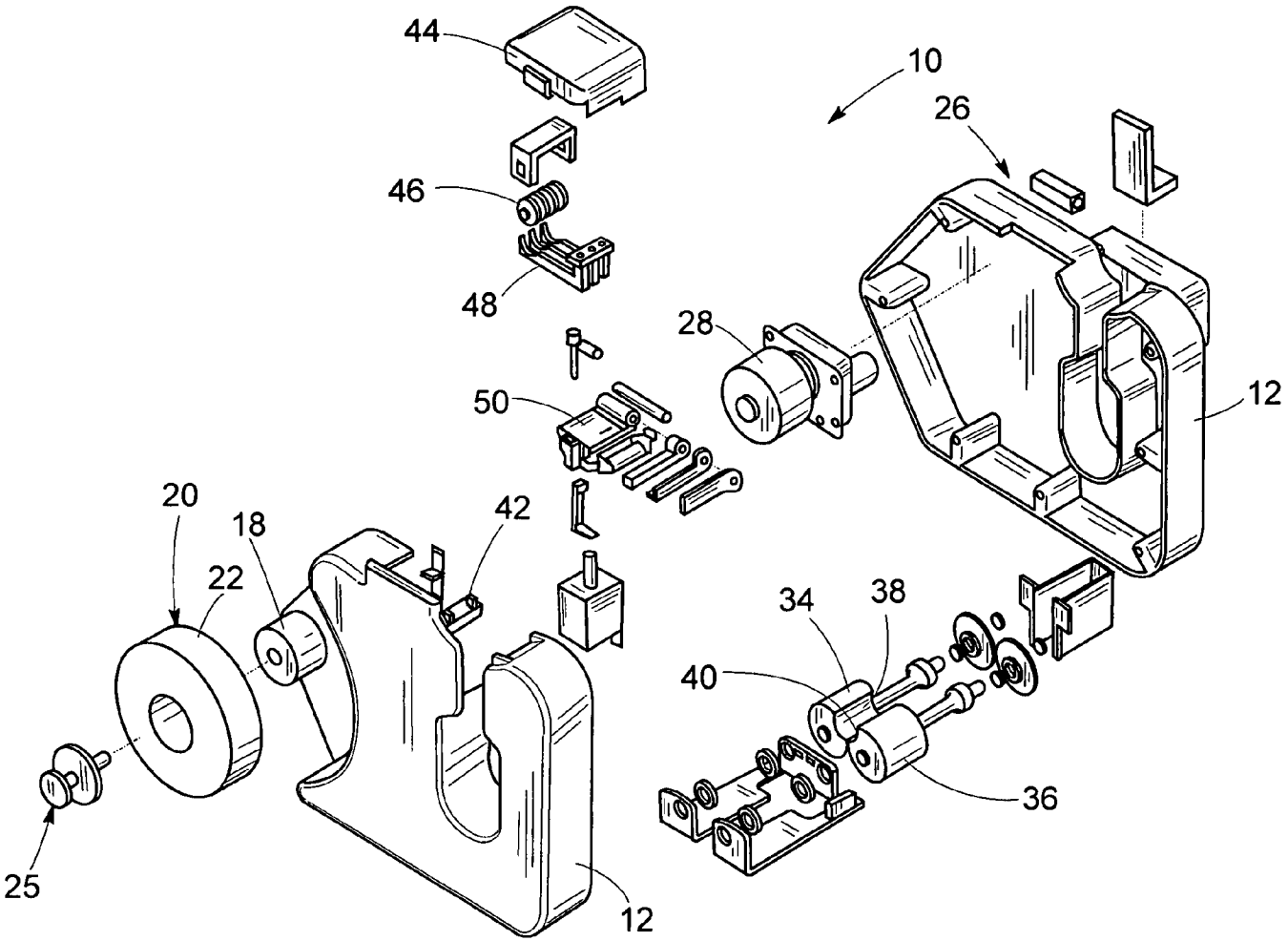
FIG. 4 is an exploded view of the banding apparatus taken from above and to one side of the apparatus.
Figure 5:
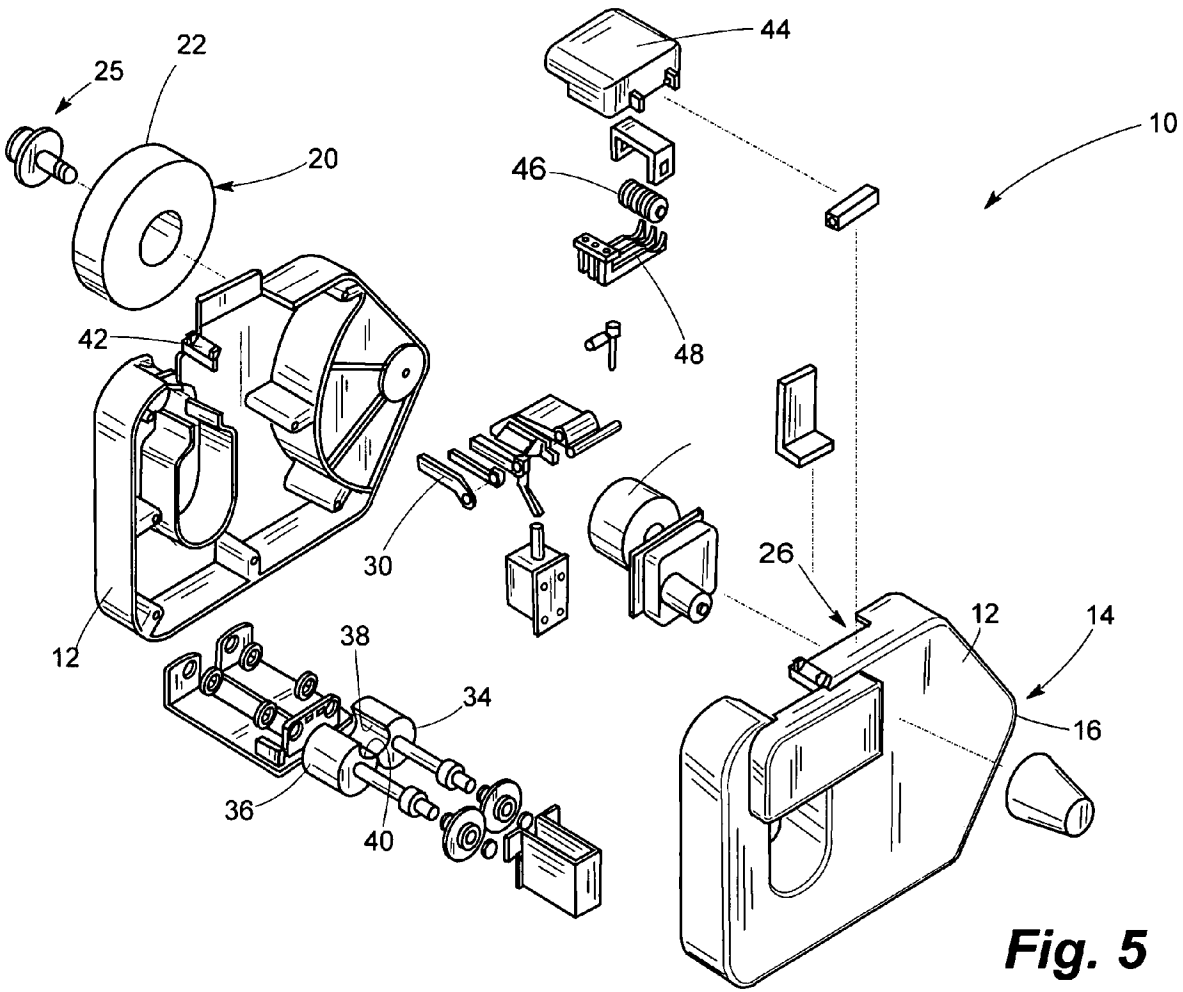
FIG. 5 is an exploded view of the banding apparatus taken from above and to the side opposite that shown in FIG. 4.

Referring now to the drawings and particularly to FIGS. 1 through 5 and 6A through 6D, a banding apparatus configured according to a preferred embodiment of the invention is seen at 10 to be formed of a housing 12 generally configured as a rectangular solid with an arcuate side wall 14 at one end ordered by a projecting boss 16 having an idler roller 18 mounted thereto. The idler roller 18 carries a roll 20 of banding material 22, the banding material preferably being formed of a paper substrate having a cohesive material 24 formed on one surface thereof. As the banding material 22 is pulled from the roll 20, that surface of the banding material 22 having the cohesive material 24 formed thereon is exposed. The cohesive material 24 is a known material having low tack qualities when contacted with surfaces other than surfaces coated with the same adhesive. Such materials often have a latex base although it is preferred according to the invention to utilize materials of this nature which are free of latex. While the idler roller 18 is not driven, it is desirable that rotation of the roller 18 is subject to at least frictional resistance so that the banding material 22 will not spool off of the roller 18. Such frictional resistance can be caused by the provision of a cap 25 over the roller 18 which can contact the roll 20 to provide a desired degree of force on the roll 20 to prevent undesired unreeling of the roll 20.

The banding material 22 is seen to be fed through a cutting station 26 by means of drive roller 28, the drive roller 28 being driven through a predetermined partial rotation to feed a predetermined length of the banding material 22 to a cutting blade 30 which is sequenced to cut the banding material 22 on discontinuation of feed of the banding material 22 by the drive roller 28. The banding material 22 is severed by the cutting blade 30 as said material 22 passes from the cutting station 26 such that severed segment 32 is located immediately outwardly of the cutting station 26 and in surmounting relationship to counter-rotating rollers 34 and 36. Each of the rollers 34, 36 are formed with arcuate notches 38 and 40 respectively above which the severed segment lies thereover and is cradled and maintained in place by guides 42 and portions of the rollers 34, 36 adjacent said notches 38, 40.

The cutting station 26 is seen to be formed of a housing 44 which is hinged such that said housing 44 can be moved to a position whereby the cutting station is opened up for necessary maintenance and other operations. The housing 44 is seen to mount a roller 46 which freely rotates such that the banding material 22 moves between the drive roller 28 and said roller 46. Flattening guides 48 extend along the path of travel of the banding material 22 within the cutting station 26 and function to maintain the banding material 22 in an essentially flat configuration. An interior housing body member 50 which forms a portion of the housing 44 mounts major portions of the guides 48 and is provided with an angled planar surface 52 which extends upwardly immediately downstream of the path of travel of the banding material 22, the planar surface 52 acting to prevent jamming of the banding material 22 as said material 22 is being fed through the cutting station 26.

The cutting blade 30 pivots in a conventional manner and is housed within a space 56 defined by the body member 50 and wall portions of the housing 44, the blade 30 being freely movable within said space 56. Actuation of the cutting blade 30 is timed by means of electronics (not shown) on circuit board 57 with the movement of the drive roller 28 such that a predetermined length of the banding material 22 is cut to form banding strip 58. It is to be understood that the banding strip 58 can be cut to any desired length depending upon the degree of rotation of the drive roller 28 as can be selected in a manner known in the pertinent art. It is further to be understood that the banding apparatus 10 functions only with the housing 44 of the cutting station 26 maintained in a closed position, the housing 44 being shown in an open position in certain figures for purposes of illustration of the structure of the invention.

Figure 6A:
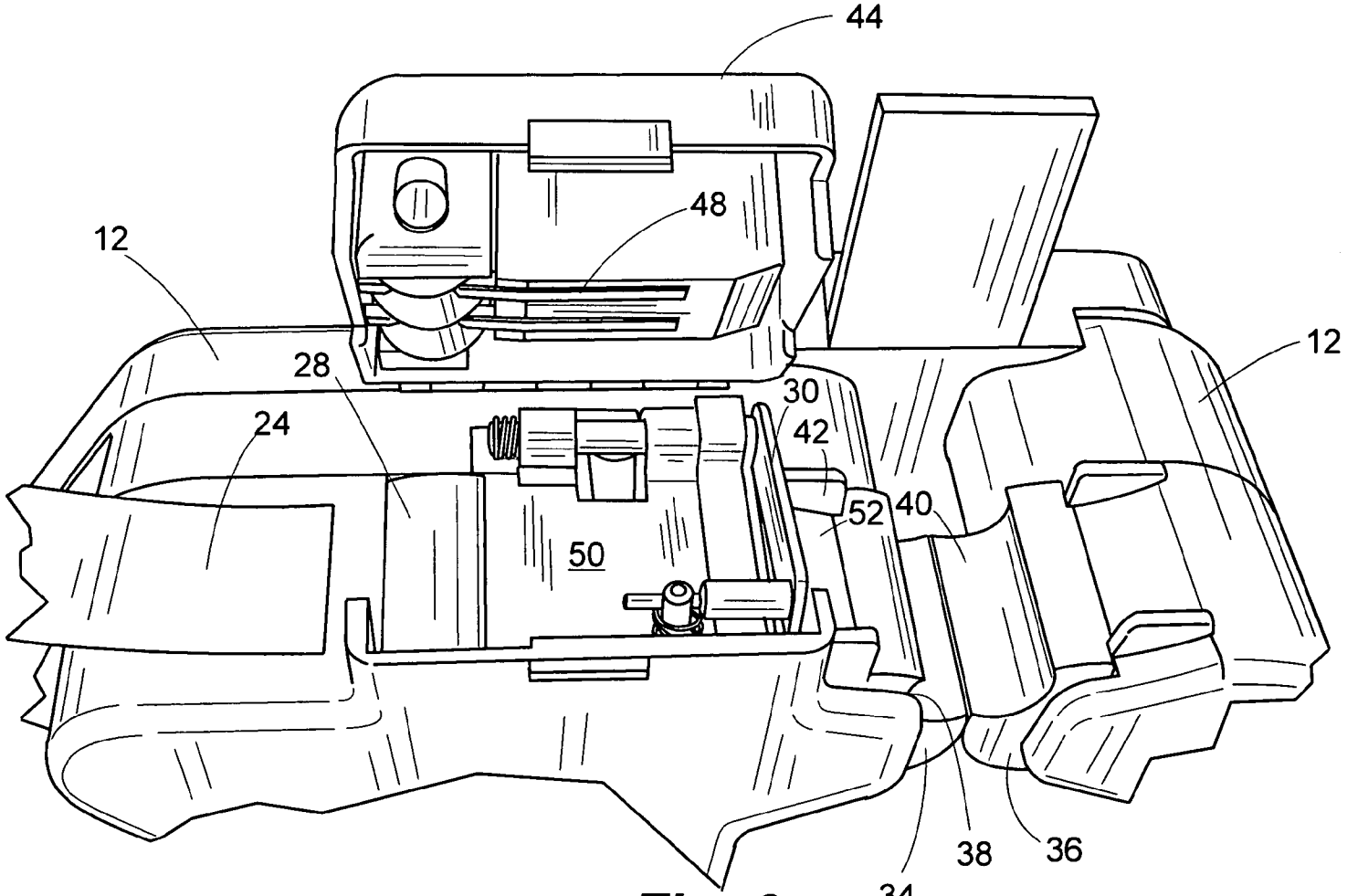
FIG. 6A is a detail perspective view of portions of the apparatus intended for severing of lengths of banding material and for mating of ends of such severed lengths together about a wrapped bundle.
Figure 6B:
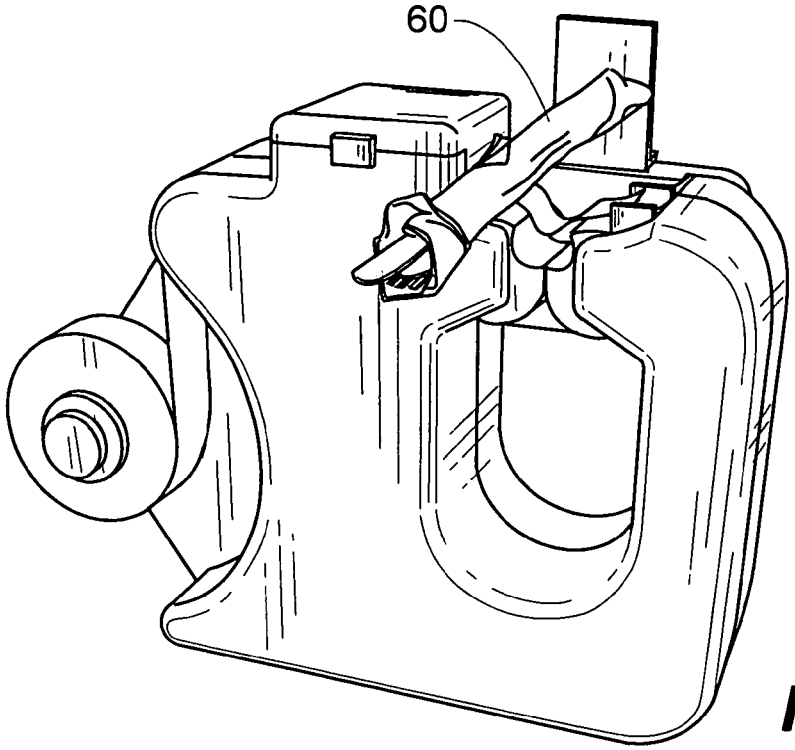
FIG. 6B is a perspective view illustrating opposing rollers and a wrapped bundle disposed immediately above a strip of banding material as occurs on initiation of movement of the bundle into engagement with the rollers.
Figure 6C:
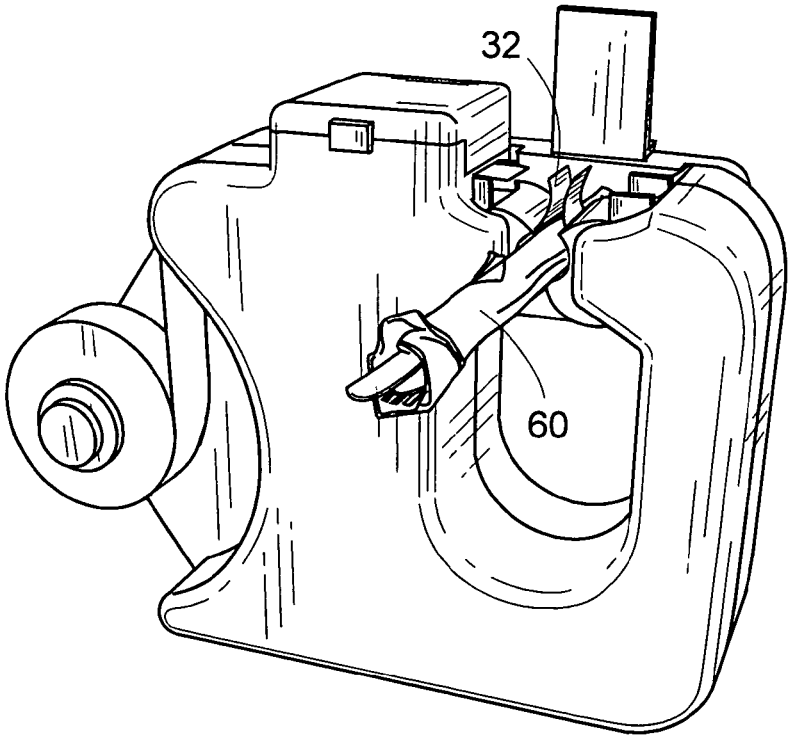
FIG. 6C is a perspective view of the wrapped bundle with a portion of the strip of banding material formed thereabout and with rollers having rotated sufficiently to cause respective notches formed in the rollers to become opposed.

Once the banding strip 58 is severed from the banding material 22 and is caused to lie in surmounting relation to the rollers 34, 36 within the guides 42 as aforesaid, a wrapped bundle 60 or desired assemblage of articles can be banded according to the invention as can best be seen in FIGS. 6B through 6D. Since the primary intent of the present invention is to band an assemblage of tableware utensils wrapped within a napkin, the wrapped bundle 60 is taken to comprise such an assemblage. However, it is to be understood that the wrapped bundle 60 can take other forms without departing from the scope of the invention. As is seen in FIG. 6B, the wrapped bundle 60 is caused to contact the banding strip 58 centrally thereof, central portions of the banding strip lying immediately above the notches 38, 40 of the rollers 34, 36 the notches 38, 40 being aligned along lowermost lateral edges thereof to form a space at 62 into which the wrapped bundle 60 in contact with the banding strip 58 can be displaced in order to contact the rollers 34, 36 and thus actuate the banding operation. On contact with the wrapped bundle 60/banding strip 58 with the rollers 34, 36, the banding apparatus 10 is actuated via electronics of conventional nature including a microswitch associated with the electronics on the circuit board 57 as well as conventional mechanisms for driving of the rollers 34, 36 so that the rollers 34, 36 are caused to undergo a rotation of a degree dependent upon the length of the banding strip 58. During this rotation as will be discussed relative to FIGS. 6B through 6D, a complete banding cycle is accomplished in essentially a single step along with a subsequent return of the rollers 34, 36 to the position shown in FIG. 6B such that a subsequent banding operation can then be undertaken.

As can be seen in FIG. 6C, the rollers 34, 36 are seen to have rotated to a degree such that lateral edges of the notches 38, 40 are aligned at respective sides of said notches, the wrapped bundle 60/banding strip 58 being then held between that space defined by the aligned and opposed notches 38, 40. Continued rotation of the rollers 34, 36 cause medial portions of the banding strip 58 to wrap fully about the bundle 60 with upper lateral edges of the notches 38, 40 acting to bring portions of the banding strip 58 together immediately prior to subsequent joining together of end portions of the banding strip 58. The rollers 34, 36 then rotate further relative to the position shown in FIG. 6C such that an opening is provided which permits the wrapped bundle 60/banding strip 58 to move downwardly of the rollers 34, 36 and into an enlarged receiving space formed in the housing 12 immediately below said rollers 34, 36 as seen in FIG. 6D. Circumferential surfaces of the rollers 34, 36 act to cinch end portions of the banding strip 58 together at locations substantially adjacent to the wrapped bundle 60 with distal end portions of the banding strip 58 not being in contact. As noted, further rotation of the rollers 34, 36 causes circumferential portions of the rollers 34, 36 to press distal end portions of the banding strip 58 together with discharge of the wrapped bundle 60 configured as the banding strip 58 now forming band 68 snuggly secured thereto, the wrapped bundle 60 then being banded according to the intent of the invention such that the resulting assemblage can then be used in a manner known in the art. As can be seen in FIG. 6D, the rollers 34, 36 rotate back to the position seen in FIG. 6B via conventional mechanisms including control mechanisms as referred to herein as soon as the banded bundle 60 passes through said rollers, thereby placing the apparatus 10 in position to band a subsequent wrapped bundle. Banding according to the intended use of the apparatus 10 is therefore capable of being rapidly accomplished with a minimum of training of persons charged with performance of the task of banding articles such as are represented by the wrapped bundle 60.

Referring now further to FIG. 6E, the band 58 is seen separately and without having the wrapped bundle 60 held thereby so as to further illustrate the structure of the band 58 as having ends of said banding strip adhered together. A prior art band is seen in FIG. 6F for comparison with the band 58, the prior art band being formed of a strip of material rolled over itself and which must have adherent material formed on both sides or otherwise formed on the prior art band to accommodate the adherent processing thereof.

It is to be understood that the invention can be practiced other than as is explicitly described herein and shown in the drawings. Control mechanisms suitable for producing the desired results are known in various arts and can be employed in implementation of control functions and the like necessary to an appropriate functioning of the banding apparatus 10. Still further, it is to be seen that a handle can be positioned at any desired location of the apparatus 10, the apparatus 10 being readily movable from storage positions to a position on a table, counter or the like such that banding operations can be accomplished when necessary with the apparatus 10 being storable in a non-use location when not required. The apparatus 10 is further seen to provide consistent banding of wrapped bundles more quickly than is possible through manual operation. In essence, the invention described herein provides function and convenience not previously available in the art. Accordingly, the scope of the invention is not limited by the explicitly disclosure provided herein but is to be defined according to the definitions provided by the appended claims.

What is claimed is:

1. Apparatus for applying a single strip of banding material having a cohesive material formed on at least portions of one side thereof to an assemblage of articles to hold said articles together in a bundle, comprising:

means for delivering the strip of material to a location whereby the assemblage of articles can be contacted with that side of the strip having the cohesive material formed thereon; and, means for biasing ends of the strip of material together and conforming medial portions of the strip about the assemblage of articles to hold said articles together;

said delivering means further comprising a single roll of banding material carried by the apparatus from which the strip of material is cut;

means for feeding portions of the roll of banding material into position for severing of the strip of material from the roll of banding material prior to engagement of the strip of material with the assemblage of articles;

wherein the biasing means comprise opposed rollers each having at least one notch formed therein, the notches being opposable on rotation of the rollers relative to each other, surfaces of the rollers in proximity to the notches contacting ends of the strip of material to cause said ends to adhere together.

2. The apparatus of claim 1 wherein the biasing means cause contact between the ends of the strip of material and contact between the assemblage of articles and medial portions of the strip in a single step.

3. The apparatus of claim 2 wherein the step occurs as a continuous motion through the apparatus.

4. The apparatus of claim 1 wherein the assemblage of articles is caused to pass into contact with the strip of material and the biasing means through manual manipulation of the assemblage.

5. The apparatus of claim 2 wherein the delivering means comprises:

means for cutting the strip of material to a desired length;

means for actuating the cutting means; and, means for advancing the strip of material to the location.

6. The apparatus of claim 5 wherein the feeding means comprise a freely rotatable roller having the roll of banding material carried thereby and wherein the cutting means comprise a cutting blade.

7. The apparatus of claim 6 wherein the actuating means comprise a solenoid and the advancing means comprises means for activating the solenoid on contact between the strip of material and the biasing means with the assemblage of article.

8. The apparatus of claim 5 wherein the advancing means comprise means for activating the actuating means on contact between the strip of material and the biasing means with the assemblage of articles.

9. The apparatus of claim 1 wherein the assemblage of articles comprises tableware.

10. The apparatus of claim 9 and further comprising a wrapping formed over the tableware.

11. The apparatus of claim 10 wherein the wrapping is a napkin.

12. The apparatus of claim 1 and further comprising a wrapping formed over the assemblage of articles.

13. The apparatus of claim 1 wherein the assemblage of articles fit into a space defined by the opposing notches as said surfaces of the rollers cause the ends of the strip of material to adhere together.

14. A method for applying a single strip of banding material having a cohesive material formed on at least portions of one side thereof and carried by a single roll of said banding material prior to severance of the strip from the roll of material, the strip being applied to an assemblage of articles to form a band to hold said articles together in a bundle, comprising the steps of:

feeding a portion of the roll of banding material into position for severing the strip of banding material from the roll of banding material;

severing the strip of banding material from the roll of banding material;

delivering the severed strip of material to a location whereby the assemblage of articles can be contacted with that side of the strip having the cohesive material formed thereon; and, biasing ends of the severed strip of material together and conforming medial portions of the strip about the assemblage of articles to hold said articles together by rotating opposed rollers each having at least one notch formed therein, the notches being opposable on rotation of the rollers relative to each other, and contacting said strip with surfaces of the rollers in proximity to the notches to cause said ends to adhere together.

15. The method of claim 14 wherein the step of biasing the ends of the strip of material together causes contact between the ends of the strip of material and contact between the assemblage of articles and medial portions of the strip in a single step.

16. The method of claim 15 wherein the assemblage of articles is caused to pass into contact with the strip of material through manual manipulation of the assemblage, the step occurring as a continuous motion.

17. The method of claim 14 wherein the assemblage of articles comprise tableware.

18. The method of claim 17 wherein a wrapping is formed over the tableware prior to application of the strip of material thereto.

* * * * *